United States Patent [19]

King

[11] Patent Number: 4,922,891

[45] Date of Patent: May 8, 1990

[54] HEARTH CONCUSSION BARRIER

[76] Inventor: Willella King, 725 W. Berkeley Ave., Evansville, Ind. 47710

[21] Appl. No.: 319,168

[22] Filed: Mar. 6, 1989

[51] Int. Cl.[5] ..... F24C 15/36

[52] U.S. Cl. ..... 126/544; 126/201

[58] Field of Search ..... 126/201, 544, 500

[56] References Cited

U.S. PATENT DOCUMENTS 4,787,366 11/1988 Bell ..... 126/500

*Primary Examiner*—Carroll B. Dority

*Attorney, Agent, or Firm*—Warren D. Flackbert

[57] ABSTRACT

A safety barrier for the corners and sharp edges, and roughened surface, of a common fireplace hearth in the form of one or more padded sections which overlie the normally exposed edge regions of the hearth. The safety barrier is defined by a framework, covered by padding and overlaid by vinyl or like material. The primary purpose of the safety barrier is to prevent injury, as to children, when the latter are proximate the hearth.

2 Claims, 1 Drawing Sheet

HEARTH CONCUSSION BARRIER

BACKGROUND OF THE INVENTION

As is evident, usage of fireplaces, in living rooms, family rooms, or the like, is widespread, where a problem oftentimes arises by reason of children playing near the hearth and thereby being cut by the corners/edges of such or even suffering abrasions due to its roughened surface. In other words, a need has arisen for some type of concussion/safety barrier usable around the front edge, corners and side edges of a hearth, and the invention presents such an item.

More specifically, the hearth safety barrier of the invention is defined by padded sections (or segments), typically for the front edge and the two front corners of the hearth, and, as desired, extending rearwardly along the side edges. In the event dimensioning demands such, a section(s) can be added, and then secured by adhesive means, loop-pile segments, or the like. Each of the sections presents resiliency/cushioning, affording an effective overlay to the normally exposed edge/corner regions of the hearth.

BRIEF DESCRIPTION OF THE DRAWING

A better understanding of the invention will become more apparent from the following description, taken in conjunction with the accompanying drawing, wherein.

Figure 1:
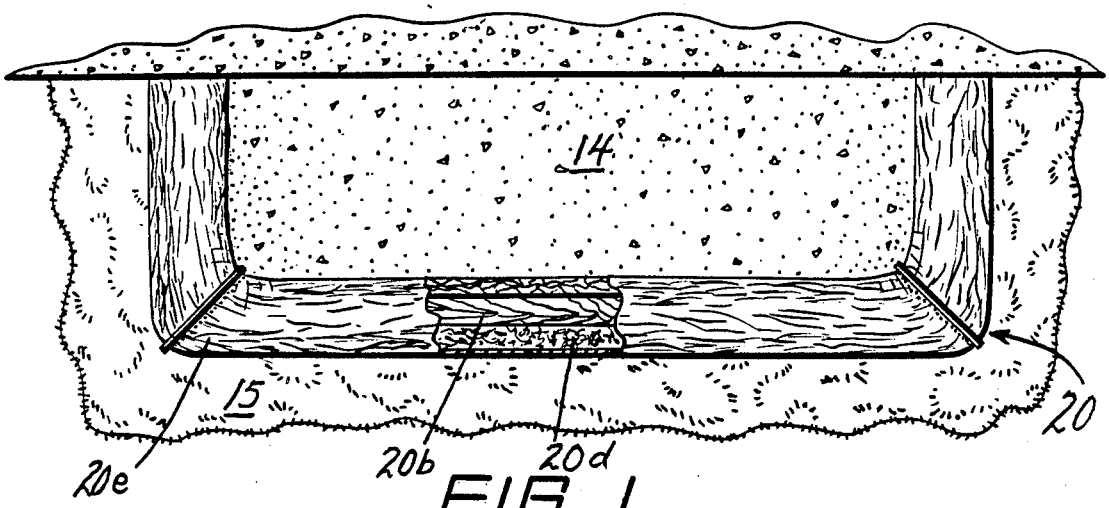
FIG. 1 is a top plan view showing a hearth safety barrier in accordance with the teachings of the present invention in a use condition.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
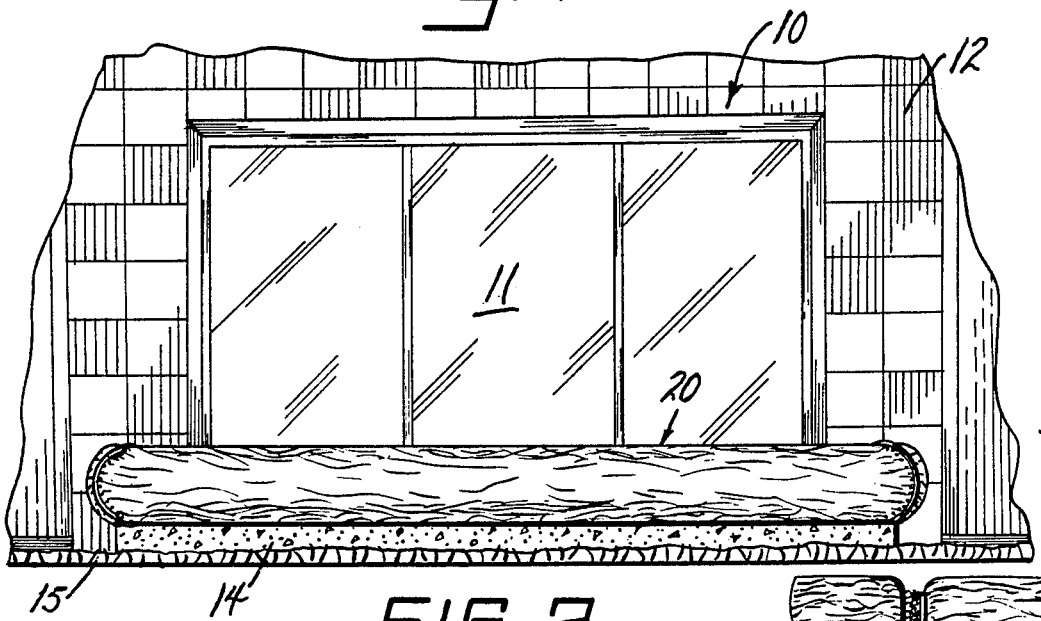
FIG. 2 is a view in front elevation of the instant hearth safety barrier, looking from the bottom to the top of FIG. 1.
Figure 3:
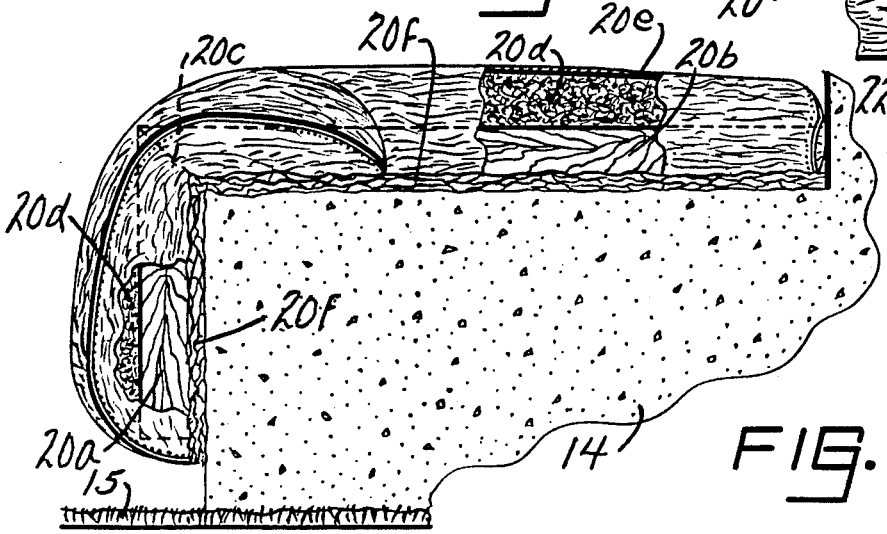
FIG. 3 is a view in side elevation, and partly broken away and in vertical section, detailing the invention; and, FIG. 4 is a fragmentary view, either from the top or from the front, showing an assembly of barrier sections.

Referring now to the figures, and particularly to FIGS. 1, 2 and 3, the hearth safety barrier of the invention is shown in combination with a common fireplace 10 installation which includes access doors 11 to the fire area, a wall 12 into which the fireplace is introduced, a hearth 14 in front of the aforesaid access doors 11, and carpeting 15 surrounding the edges of the hearth 14. It should be understood that the hearth 14 may assume any desired height, where that illustrated in FIG. 2 is representative.

Hearth safety or concussion barrier 20 presented herein may assume various forms size-wise, i.e. may be assembled to present a single unit for safety barrier purposes; may include a separate or independent section, as along the front, if dimensioning so dictates; and, may include corner sections blending into a front section and into sections partly along the side edges of the hearth.

In any event, the hearth safety barrier 20 is basically a framework defined by wooden sections 20*a*, 20*b*, secured together at mitered joints 20*c*, and overlaid with padding 20*d* and, ultimately, an outer cover material 20*e*, such as known vinyl. An inner cushioning wall 20*f* serves further covering purposes and completes the assembly.

After placement on the hearth 14, the hearth safety barrier 20 presents a cushioning effect and, as evident in each of the figures (see FIG. 3 particularly), overlies the edges of the hearth 14, including the corners. The safety barrier 20 prevents any unintentional contact with the corners or sharpened edges of the hearth 14.

While the assembled unit is preferably fire and/or flame resistant, but if such were not the instance, the removal of the hearth safety barrier 20 would be a necessity for fireplace usage, but it is unlikely anyway that a child would be in such close contact with the hearth 14 during a burning and/or use condition.

Figure 4:
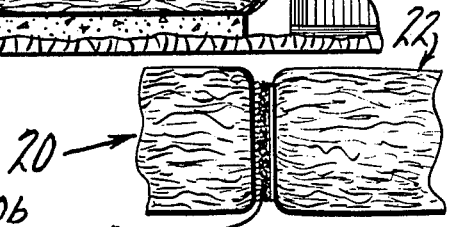

With reference now to FIG. 4, and as stated previously, some situations may physically require the use of an added safety barrier section(s) 22. Fastening and/or securement, at 22*a*, as through loop-pile segments, can achieve a firmly assembled safety barrier unit accommodating particular dimensioning requirements.

It should be evident, therefore, that the invention satisfies a need by precluding unwanted/accidental contact with sharpened edges and/or corners, or roughened surfaces, presented by the usual hearth. An assembled safety barrier is readily dropped into an operative overlying condition with the hearth, effectively preventing any unwanted direct physical contact therewith. It should be further evident that the instant safety barrier is lightweight, readily transported, easily placed into an operative position, and capable of assuming any desired ornamental appearance to harmonize with a use condition setting.

The hearth safety barrier described hereabove is susceptible to various changes within the spirit of the invention, as, for example, in proportioning; the configurations in vertical section, i.e. such may assume an oval shape in contrast to a blended curve; the framework may be other than wooden sections; the corner configuration may be enlarged; and, the like. Thus, the preceding description should be considered illustrative, and not as limiting the scope of the following claims:

I claim:

1. In combination with a fireplace installation having a hearth defined by an exposed front edge, front corners and side edges, a hearth concussion barrier comprising a rigid framework in the form of preassembled padded sections concealing said front edge, said front corners and said side edges in a protective impact resistant relationship, where padding between said framework and a portion of the front and the top of said hearth serves in a further protective impact resistant relationship, and where said hearth concussion barrier is selectively placed and removed from said protective impact resistant relationship on said hearth without the need for independent securement.

2. The fireplace installation of claim 1, where an added padded section accommodates use requirements, and where releasable means secure placement of said added padded section to a next adjacent padded section.

* * * * *